US006213919B1

(12) United States Patent
Wang et al.

(10) Patent No.: US 6,213,919 B1
(45) Date of Patent: Apr. 10, 2001

(54) ANTI-TOPPLING DEVICE FOR TREADMILL'S FRAME

(76) Inventors: Leao Wang; Peter Wu, both of No 1, Lane 154, Charng Long Rd., Taiping (TW), 411

( * ) Notice: Subject to any disclaimer, the term of this patent is extended or adjusted under 35 U.S.C. 154(b) by 0 days.

(21) Appl. No.: 09/394,255

(22) Filed: Sep. 13, 1999

(51) Int. Cl.[7] ..... A63B 22/02
(52) U.S. Cl. ..... 482/54
(58) Field of Search ..... 482/51, 54

(56) References Cited

U.S. PATENT DOCUMENTS 5,827,155 * 2/2000 Jensen et al. ..... 482/54
6,019,707 * 2/2000 Wang ..... 482/54

* cited by examiner

*Primary Examiner*—Glenn E. Richman
(74) *Attorney, Agent, or Firm*—Kuo-Hsiung Chiu

(57) ABSTRACT

An anti-toppling device for treadmill's frame comprising a front supporting lever, a handgrip frame, a frame, a running belt and a rear supporting lever, characterized in that the bottom end of one side of said frame of said treadmill is fitted with a pneumatic cylinder on which cylinder on which an auxiliary supporting element and a turning spring are mounted, and that a mounting member on one side of said supporting element and a locating hole of said turning spring together with a pivoting member of an application rod of said pneumatic cylinder are pivoted on the same locating shaft of said frame so that, when said frame is raised in an upright folded state, said supporting element will be shifted upwards with the position of said locating shaft while said application rod of said pneumatic cylinder is in a synchronically protruding state until said engaging member at the bottom end of the middle section of said supporting element is supported at the side edge of a main body of said pneumatic cylinder so that the desired anti-toppling effect can be achieved.

3 Claims, 4 Drawing Sheets

ANTI-TOPPLING DEVICE FOR TREADMILL'S FRAME

BACKGROUND OF THE INVENTION

1. Field of the Invention

The present invention relates to an anti-toppling device for treadmill's frame, and more particularly, to a device through which the treadmill won't be toppled over when it is placed in an upright folded state and hit by any unexpected factors. Therefore, the toppling event can be avoided and the safety of people and objects can also be protected.

2. Description of the Prior Art

All of treadmill of the prior art can be raised upwards to a proper angle to be in a upright folded state in order to reduce the occupied space and to facilitate the position movement. However, when the frame is raised, it is supported by ad pneumatic cylinder disposed at one side of the bottom of the frame to achieve the anti-toppling effect. This prior art is disclosed in U.S. Pat. Nos. 5,676,624, 5,868,648, 5,833,577, etc.

Nevertheless, the treadmill isn't light so that the frame thereof is easily toppled over by unexpected external factors (e.g. incidentally hit by persons or objects or shaken due to earthquake or falling of heavy objects onto the ground). This will seriously endanger the safety of persons and objects. Certainly, it will also cause malfunction of the device.

SUMMARY OF THE INVENTION

It is a main object of the present invention to provide an anti-toppling device for treadmill's frame through which the treadmill won't be toppled over when it is placed in an upright folded state and hit by any unexpected factors. Therefore, the toppling event can be avoided and the safety of people and objects can also be protected.

BRIEF DESCRIPTION OF THE DRAWINGS

The drawings disclose illustrative an embodiment of the present invention which serves to exemplify the various advantages and objects hereof, and are as follows.

DETAILED DESCRIPTION OF THE PREFERRED EMBODIMENT

Figure 1:
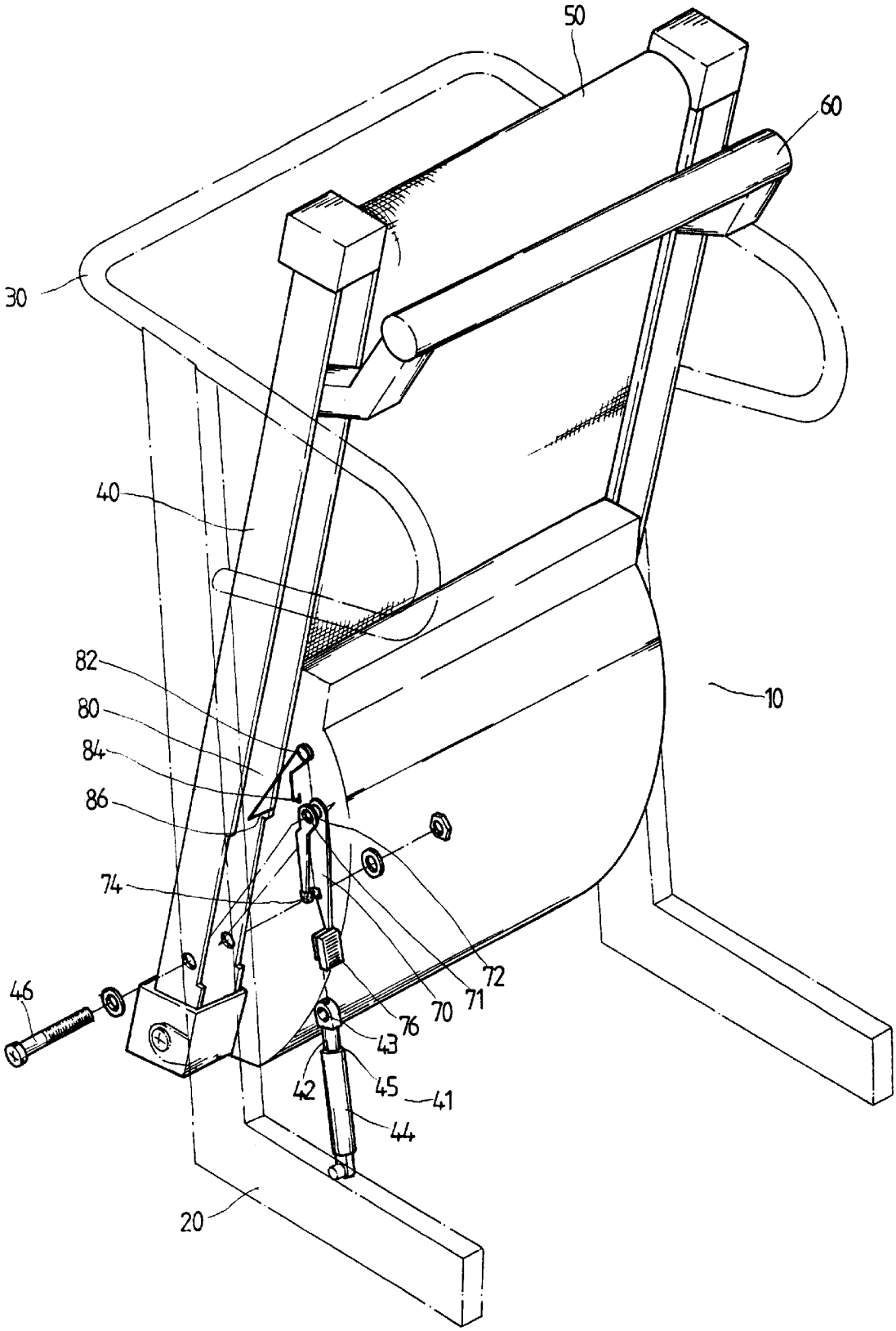
FIG. 1 is an exploded perspective view of an anti-toppling device in accordance with the present invention.

First of all, referring to FIG. 1, the anti-toppling device for treadmill's frame in accordance with the present invention is fitted to one side of the frame's bottom of the conventional treadmill, and the treadmill 10 includes a front supporting lever 20, a handgrip frame 30, a frame 40, a running belt 50 and a rear supporting lever 60, wherein the bottom end of one side of the frame 40 of the treadmill is fitted with a pneumatic cylinder 41 on which an auxiliary supporting element 70 and a turning spring 80 are mounted, and wherein a mounting member 72 on one side of the auxiliary supporting element 70 and a locating hole 82 of the turning spring 80 together with a pivoting member 43 of an application rod 42 of the pneumatic cylinder 41 are pivoted on the same locating shaft 46 of the frame 40.

The auxiliary supporting element 70 is hollow-shaped through which the pneumatic cylinder 41 can be plugged, wherein one end thereof is provided with the mounting member 72 with mounting holes 71, and wherein the middle bottom end thereof is fitted with engaging member 74 made of soft material, and wherein another end thereof is formed to be a foot pedal 76.

One foot 84 of the turning spring 80 is hooked at the bottom end of the supporting element 70 while another foot 86 is supported at a corner of the inner side of the frame 40 so that the supporting element 70 can be permanently pushed toward the pneumatic cylinder 41 through the effect of the turning spring 80.

Figure 2:
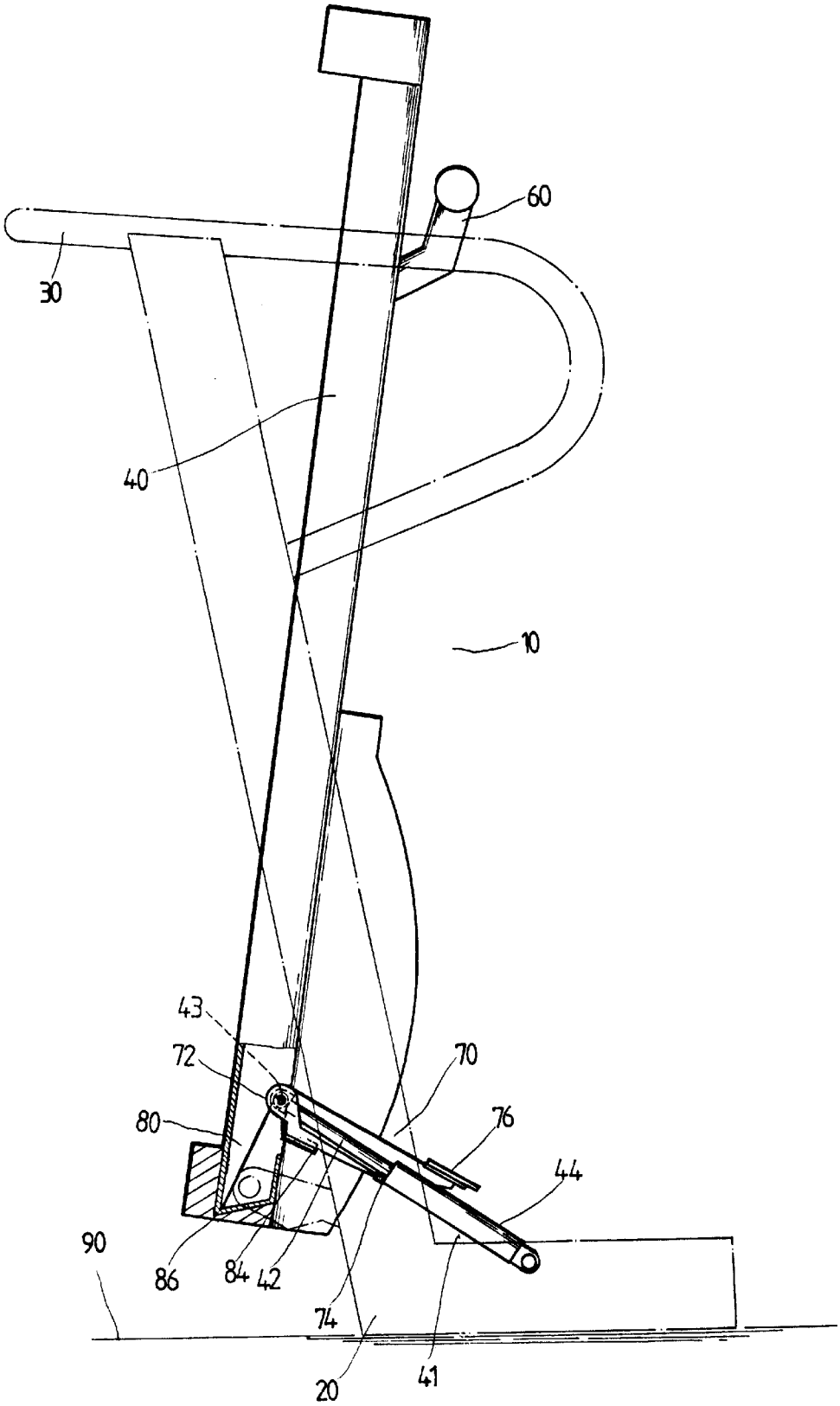
FIG. 2 is a side view of the present invention after assembly in a supporting state.

Accordingly, as shown in FIG. 2, when the frame 40 is raised in an upright folded state, the supporting element 70 will be shifted upwards with the position of the locating shaft 46 while the application rod 42 of the pneumatic cylinder 41 is in a synchronically protruding state until the engaging member 74 at the bottom end of the middle section of the supporting element 70 is supported at the side edge 45 of a main body 44 of the pneumatic cylinder 41 so that the desired anti-toppling effect can be achieved.

Figure 3:
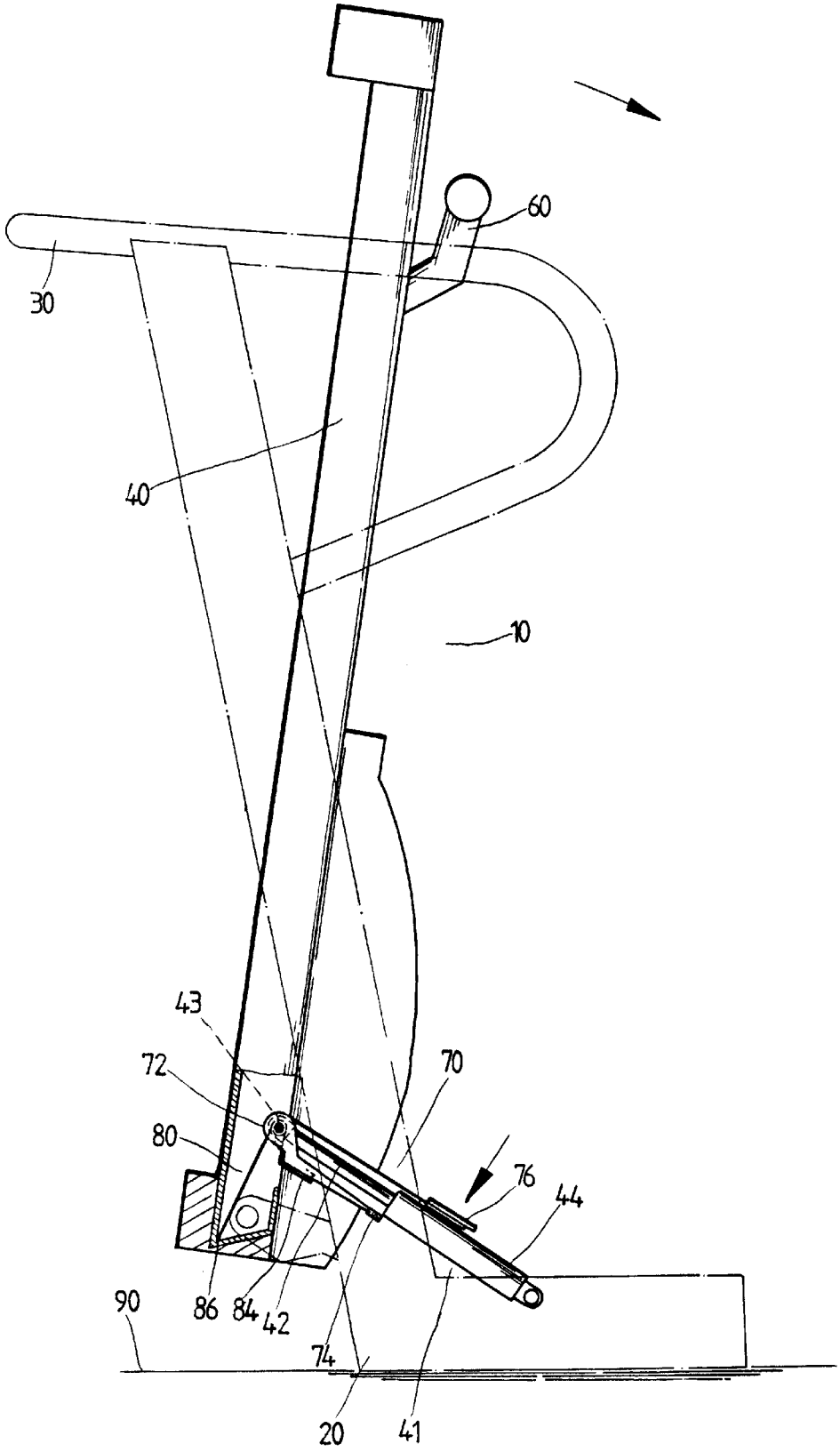
FIG. 3 is a schematic drawing illustrating how the supporting effect in accordance with the present invention is removed.
Figure 4:
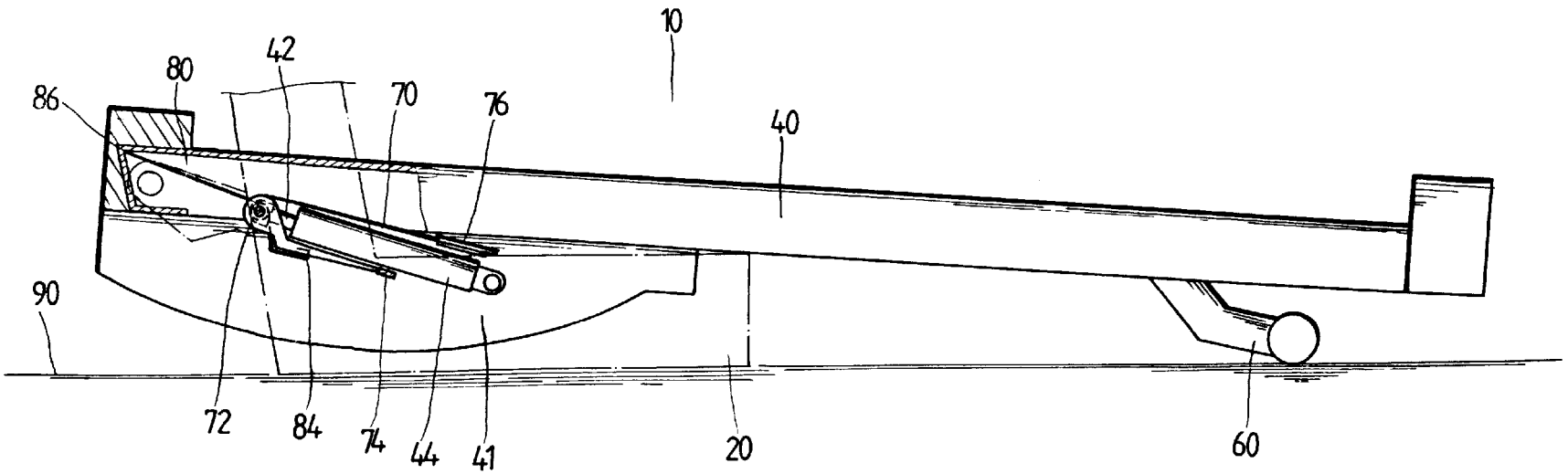
FIG. 4 is a schematic drawing of the present invention illustrating the position thereof in a flat ready-to-use state.

Furthermore, referring to FIGS. 3 and 4, in removing the supporting effect of the supporting element 70, the user has to tread on the foot pedal 76 of the supporting element 70 so that the supporting element 70 is shifted downwards around the locating shaft 46. At that time, the engaging member 74 of the supporting element 70 won't be supported at the side edge 45 of the main body 44 of the pneumatic cylinder 41 any more so that the frame 40 can be moved downwards. Moreover, the application rod 42 of the pneumatic cylinder 41 is gradually moved into the main body 44 of the pneumatic cylinder 41 with the position change of the locating shaft 46 until the frame 40 is flat placed on the ground 90.

Many changes and modifications in the above-described embodiment of the invention can, of course, be carried out without departing from the scope thereof. Accordingly, to promote the progress in science and the useful arts, the invention is disclosed and is intended to be limited only by the scope of the appended claims.

What is claimed is:

1. An anti-toppling device for a foldable treadmill having a front supporting frame, a handgrip frame extending upwardly from the front supporting frame and a running belt frame movable relative to the front supporting frame between a use position and a storage position, the anti-toppling device comprising:

a) a cylinder having a first end connected to the front supporting frame and a second end, a movable application rod extending from the second end, a distal end of the application rod connected to the running belt frame such that the application rod extends from the cylinder when the running belt frame is in the storage position;

b) a supporting element pivotally connected to the running belt frame, the supporting element having an engaging member and being movable between a first position, wherein the engaging member contacts the second end of the cylinder thereby preventing retraction of the application rod into the cylinder, and a second position wherein the engaging member is displaced from the second end of the cylinder; and, c) a turning spring acting between the support element and the running belt frame so as to bias the engaging member towards the first position.

2. The anti-toppling device of claim 1 wherein the supporting element further comprised a foot pedal.

3. The anti-toppling device of claim 1 wherein the supporting element and the distal end of the application rod are pivotally attached to the running belt frame so as to pivot about a common shaft.

* * * * *